United States Patent [19]

Hadjiiski et al.

[11] Patent Number: 4,638,607

[45] Date of Patent: Jan. 27, 1987

[54] BOX-UNIT AND MOLDING APPARATUS FOR ITS PRODUCTION

[75] Inventors: Anatoli M. Hadjiiski; Hristo P. Varbanov; Michail T. Mishonov; Vladimir P. Stamov; Rosen P. Savov; Strahil K. Radenkov; Vladimir B. Panev; Alexander S. Velev, all of Sofia, Bulgaria

[73] Assignee: Issledovatelski Centar "Tekom", Sofia, Bulgaria

[21] Appl. No.: 735,432

[22] Filed: May 17, 1985

[30] Foreign Application Priority Data

May 17, 1984 [BG] Bulgaria ..... 65533
Jun. 28, 1984 [BG] Bulgaria ..... 66037

[51] Int. Cl.[4] ..... E04B 1/348
[52] U.S. Cl. ..... 52/79.9; 52/79.1
[58] Field of Search ..... 52/79.1, 79.7, 79.8, 52/79.9, 79.12, 79.13

[56] References Cited

U.S. PATENT DOCUMENTS 4,184,296 1/1980 Vitalini ..... 52/79.7 X
4,211,043 7/1980 Coday ..... 52/79.1
4,432,171 2/1984 Boot ..... 52/79.1

FOREIGN PATENT DOCUMENTS 483485 10/1975 Australia ..... 52/79.14
2320917 1/1974 Fed. Rep. of Germany ..... 52/79.1
2728474 1/1974 Fed. Rep. of Germany ..... 52/79.7
1002385 10/1951 France ..... 52/79.1

*Primary Examiner*—Alfred C. Perham

[57] ABSTRACT

The invention relates to an open type box-unit with multipurpose application for the complex industrial construction of prefabricated houses, of buildings with different numbers of stories, and to molding apparatus for its production. The box-unit has a floor and roof structure with a spatially reinforced concrete framework consisting of two longitudinal frames and transverse frames; the cross bars of the longitudinal frames have a reinforced cross section asymmetrical to the cross section of the columns and a uninterrupted reinforcement in a closed shape. At modular distances in the cross bars of the longitudinal frames there are provided critical zones with cross sections doubled with regard to the cross bars and the columns of the end transverse frames. These critical zones are designed for the connection of the reinforcement of the cross bars and the columns of the middle frames having variable cross sections. The molding facility comprises lower forms split in sections along the transverse axis of which there are form mebers connected with a system of hydraulic units. On a "Π"-shaped plain girder there are horizontal forms sectional in a transverse direction with upper forms on a system of stabilized Nurnberg shears there are external and internal seetional vertical forms. The molding facility is equipped with grouting units.

4 Claims, 16 Drawing Figures

FIG. 1
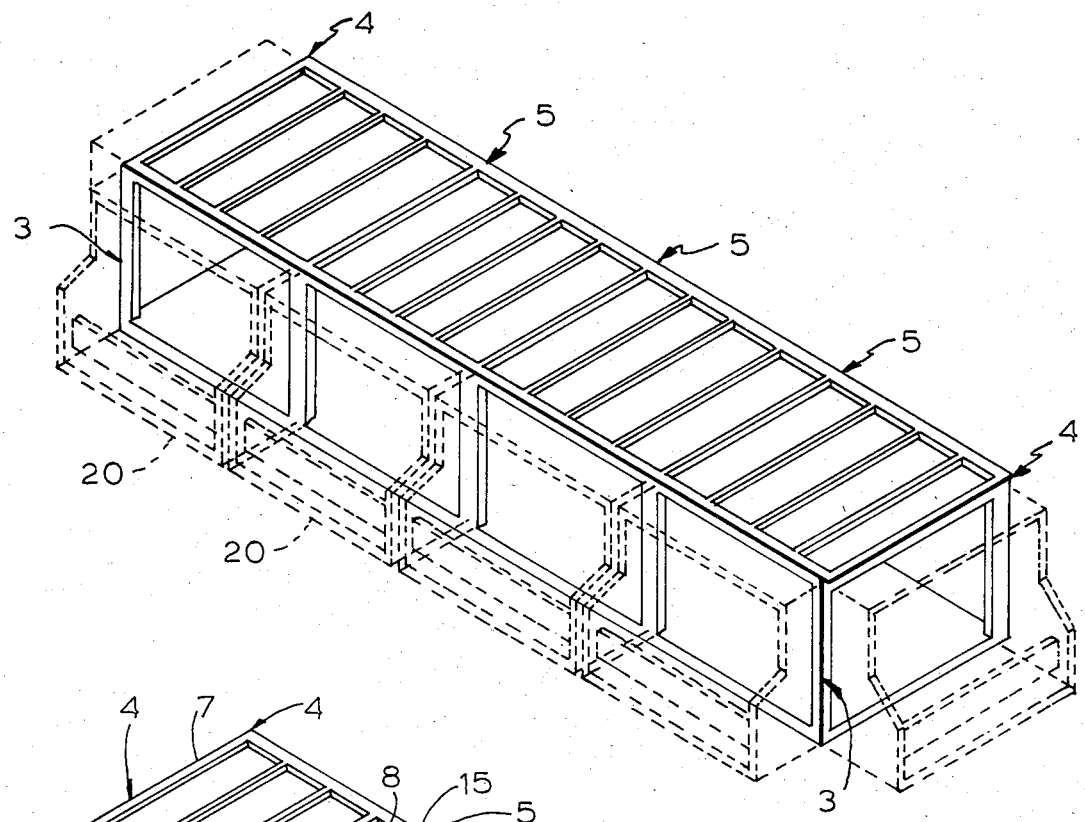
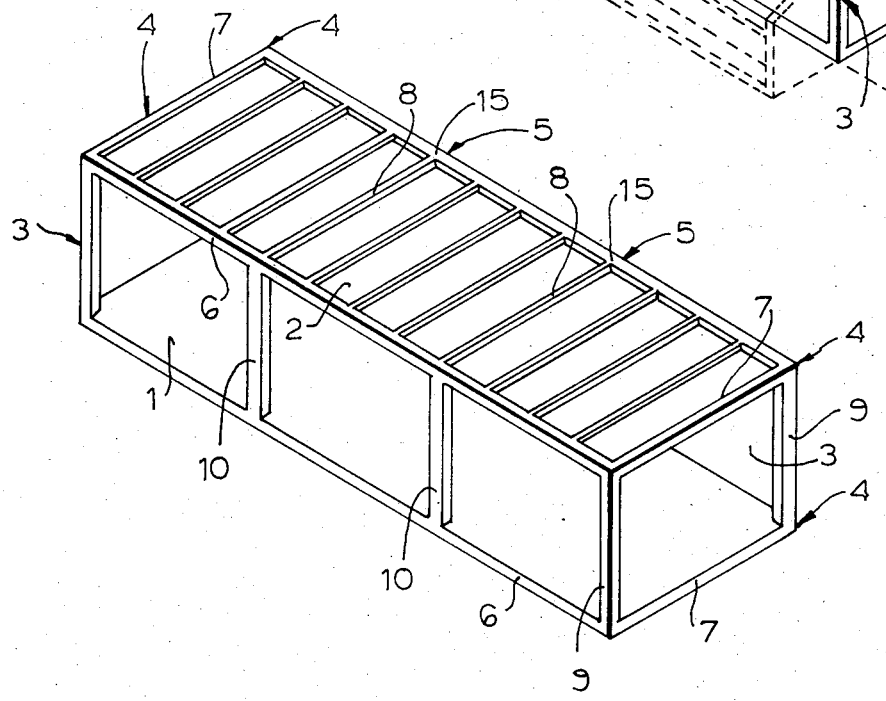
FIG. 2

BOX-UNIT AND MOLDING APPARATUS FOR ITS PRODUCTION

This invention relates to a box-unit designed to construct buildings mainly in the civil engineering field, to a molding apparatus for the production of an open type box-unit with a multi-purpose application, and particularly to a building which finds application in the complex commercial construction of various prefabricated one-family and multistory houses.

The Virendel type box-unit is well known; it comprises a floor slab and a ceiling slab with stiffening ribs supported by a longitudinal Virendel type 3-opening frame ending at both ends with wall panels. The face framework of the box-unit has "⊓"-shaped transverse frame members with columns having a "/"-shaped cross section forming the place for positioning the box-unit of the following story.

This box-unit has the following disadvantages. It restricts the architectural solution to only constructions wherein the Virendel type frame openings and the vertical columns determine the possible places of the partition walls, i.e., it is possible for these to be flush mounted. Thus, any modifications in the architectural solution in the sense of the internal arrangement are to be looked for within each box-unit. The predetermined position of the box-unit belonging to the next story renders impossible the variations in the facade arrangement along a vertical axis of box-units.

Another known box-unit which represents an open parallelepiped obtained by the assembly of two or more prestressed "⊓"-shaped frames with the floor and roof structures forming a spatially reinforced concrete framework of two longitudinal frames and transverse frame consisting of the appropriate cross bars and columns is intended for the construction of civil engineering commercial projects. The transverse frames are at least two at the ends and at least one in the middle of the box-unit.

The disadvantages of the latter lie in the fact that the member formation of the box-unit by prestressed steel reinforcement does not allow for the spatial-elevation arrangement of the intrastory space and of the separate stories in the production process. This box-unit provides for the construction of buildings with a fixed exterior only, thus reducing the possibility to diversify urbanization and to develop the varying intra-quarter space areas and spatial construction solutions resulting from the uniformity of the box-units and the fixed connection of the columns. It is also impossible for the box-units to be assembled rotated at 90° one above the other wherever various arrangements from the point of view of architecture and performance are required, since the prestressed reinforcement and the small transportable width of the box-unit present obstacles to it.

A molding facility or apparatus for the production of open type box-units with multi-purpose application and in particular of all the building members forming the building in the complex industrial construction of various prefabricated houses is not known.

There is molding apparatus for the manufacture of large sized box-units which comprises lower forms with a grouting machine to produce the floor slab of the box-unit. Above the lower forms there are horizontal and upper forms, respectively positioned one above the other to form the ceiling slab by means of a grouting machine. The forms are covered by a crane track carrying two special hoist mechanisms. The horizontal forms are supported by a structure of two cantilever trellis girders with a triangular cross section turned top down and the two lower girdles of the girder cross section form the rail track on which the grouting machine overhangs to make the floor slab. The cantilever girders are supported at one end by the foundation of the molding apparatus by means of bearing mechanisms, while at the other end they are bolted to the support frames of the crane track. On the four columns of the crane track there are vertical internal and external forms connected by means of double-hinged four-link units. The vertical forms include two basic steel plates with four double-hinged forms and face hinged to them. Two hydraulic cylinders complete with lifting bars are hinged to each of the hoist mechanism. The molding apparatus also incorporates two special one-beam cranes. On one of the cranes there are two electric hoists cantilever-mounted at different distances while on the other crane there is connected a grouting machine by means of two hinged hydraulic mechanisms.

Disadvantages of the above unit are that it is designed to produce box-units of a fixed configuration which cannot be used universally for the whole variety of building members in a building. Moreover, the resultant box-unit restricts the diversification of the architectural-elevation solutions for the blocks of the flats constructed. In addition, the facility does not permit maximum mechanization and a high degree of programing of the separate technological operations and in general the complex industrial construction of various prefabricated buildings.

The object of the invention is to create a box-unit which provides the possibility of assembly with both horizontal and vertical rearrangements with the purpose of great diversification of urban development solutions and the maximum utilization of the intra-quarter areas. Also, the box-unit can be manufactured in the same forms and allow for the production of various buildings with regard to their exteriors and different applications.

The aim of the invention is to create a molding apparatus for the manufacture of box-units by means of which to produce a divisible monolithic box-unit module or a part thereof which can be of a frame design of cross bars and columns movable as to their locations and varying in cross section, and which can be built up either or without the webs of the beams for all the building members in a building providing the possibility to maximize mechanization and up to a large extent program the technological operations and as a whole the complex industrial construction of various prefabricated buildings.

The problem is solved with a box-unit including a floor and a roof structure carried by a spatially reinforced concrete framework composed of longitudinal and transverse frames formed with cross bars and columns one cross bar at each end, and at least one cross bar in the middle of the frame. According to the invention, the cross bars of the transverse frames have a reinforced cross section located asymmetrically with regard to the cross section of the columns and an uninterrupted equal reinforcement of the upper and lower cross bar representing a closed shape incorporating the cross bars of the longitudinal frames and the columns of the end transverse frames. At a modular distance from each other in the cross bars of the longitudinal frames and the columns of the end transverse frames. At a modular distance from each other in the cross bars of the longitudinal frames and the columns of the end transverse frames. At a modular distance from each other in the cross bars of the longitudinal frames there are provided critical zones of a double cross section with regard to the cross bars and the columns of the end transverse frames. These critical zones are provided for the connection of the reinforcement of the cross bars and columns of the middle transverse frames. The cross section of each cross bar and column in the middle transverse frames varies within the range from once to twice the cross section of the cross bar or the column respectively. It is recommended that two critical zones by provided at the cross bars of the longitudinal frames, thereby to form three modular lengths. Another possibility is for the critical zones on the longitudinal cross bars to be one per cross bar, thus forming two modular lengths. At least two opposite critical zones on the cross bars of the longitudinal frames are connected in-between by means of the cross bars of the middle transverse frames only.

The invention also includes a molding apparatus for boxunits in which form members connected to hydraulic mechanisms are hinged along the transverse axis of the lower forms. The sectors of the lower forms forming the longitudinal side beams of the form member are complete with a system of hydraulic units. The lower forms are made divisible in sections in the places of the floor cross bars and/or in the intrarib spaces of one of the end sectors. One end of the "⊓"-shaped plain girder carrying the lower grouting machine is welded on "⊓"-shaped stationary frames along the longitudinal axis of the lower forms. The other end of the plain girder is hinged to a hydraulically driven support, the loose end of the latter lying in a shaped chute. On the "⊓"-shaped plain girder there are sectional horizontal forms fastened in a transverse direction with rotating form strips situated parallel to the longitudinal axis of the horizontal forms and connected through a programable hydraulic system to the props of the plain cantilever girder. Upper forms divisible by length at the places of the ceiling cross bars and/or in the spaces between the ribs of one of their end sectors are situated above the sectional horizontal forms. Vertical "⊔"-shaped forms having a programable hydraulic movement are hanging on a system of Nurnberg shears strengthened by upper operator's platforms between the lower and horizontal forms to produce the external wall of the columns. On the internal walls of the columns there are attached vertical 3-wall forms the end walls of the latter being hinged to their middle wall which is, on its part, connected to a cantilever having a horizontal movement and to a hydraulic cylinder hanging on a "⊓"-shaped girder. On the external vertical edges of the end walls of the 3-wall forms there are "⌐"-shaped sections for the webs of the beams. The rotating form strips of the horizontal forms have on their external part changeable "⌐"-shaped sections for webs of the beams. To the sectors of the lower forms forming the cross bars and the inter-rib spaces, and to the vertical forms, there are provided sets of typical inserts of cross sections different from the lower forms in the sectors for molding the balconies divisible in overall dimensions and for fixing webs of beams.

Advantages of the box-unit according to the invention are that it provides the possibility to construct buildings with a horizontal and vertical splitting of the facades, and the box-units can be assembled with a displacement or turned at 90° to each other. Thus, they ensure a variety of urban development solutions, and maximum use of the intra-quarter spaces. It is possible to have the partition walls as early as during the box-unit molding or afterwards at any place, while the internal space can be organized in one, two or more boxes by means of walls performing the function of partition. The box-unit can be made with variable cross sections of columns, or without some of them so as not to form obstacles in the internal architectural arrangement. The box-unit according to this invention can be manufactured in the same forms, and all building members can be constructed therewith since the structural solution allows for its multi-purpose application.

The advantages of the molding facility are that it produces a divisible monolithic box-unit or a part thereof with a framework of variable cross bars and columns with regard to the places and cross sections of these in the molding facility. The box-unit can be built with or without webs of beams and cover all the building members in a building such as varying in span boxes, basements, stairways, roof and terrace-like members, loggias and balconies depending on their application for the unique architectural-elevation arrangement of various prefabricated buildings and houses in their complex industrial production. Along with the above advantages, the molding facility provides the possiblity to maximize mechanization and to program to a high degree the separate technological operations and in general the complex industrial construction of various prefabricated buildings.

An exemplary illustration of the invention is shown on the attached figures, wherein:

FIG. 1 is a view in axonometric projection of the box-unit of the invention in its complete technological size;

FIG. 2 is a fragmentary view in a similar projection of the box-unit with its basic structural members;

Figure 11A:
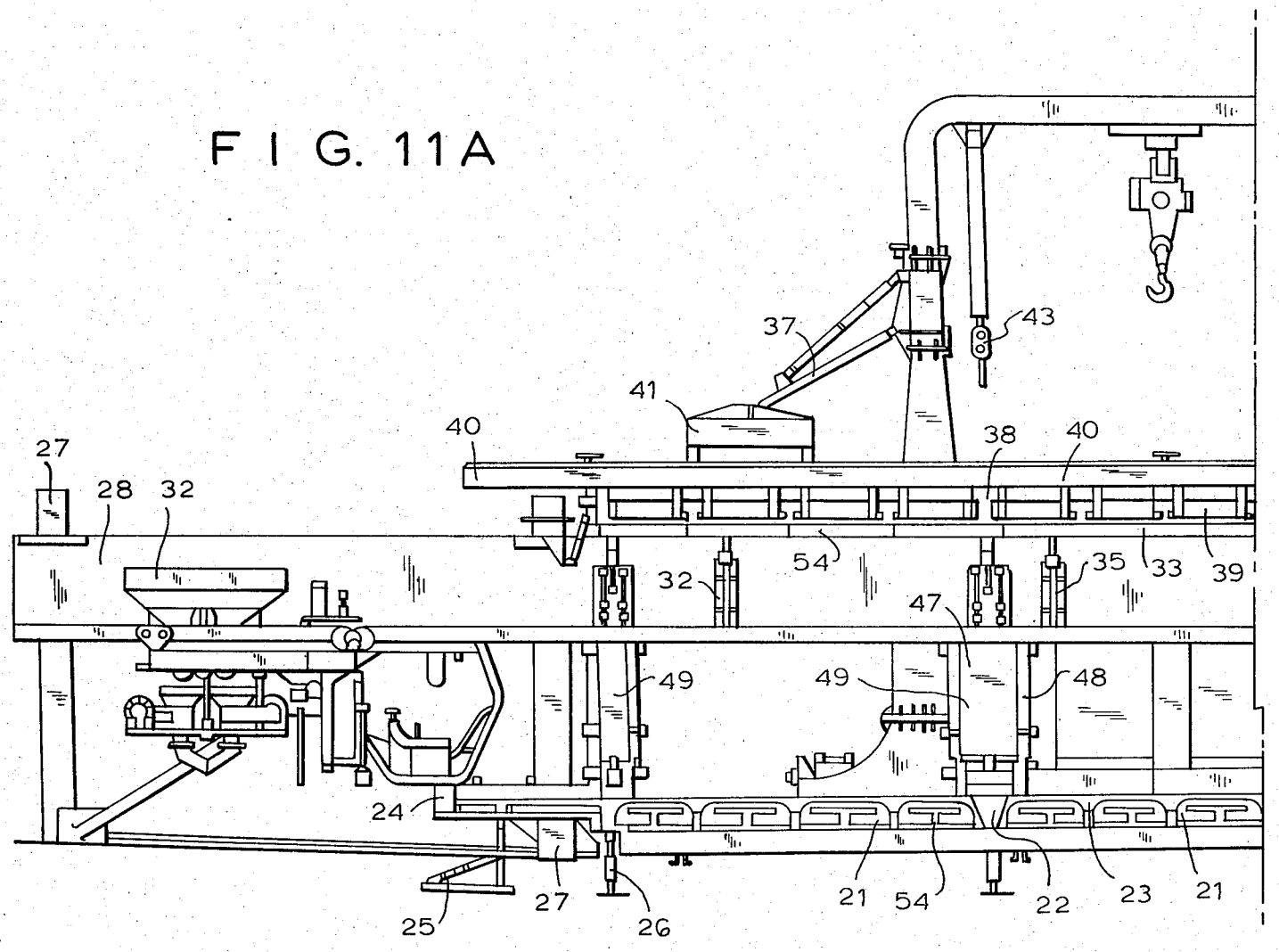
Figure 11B:
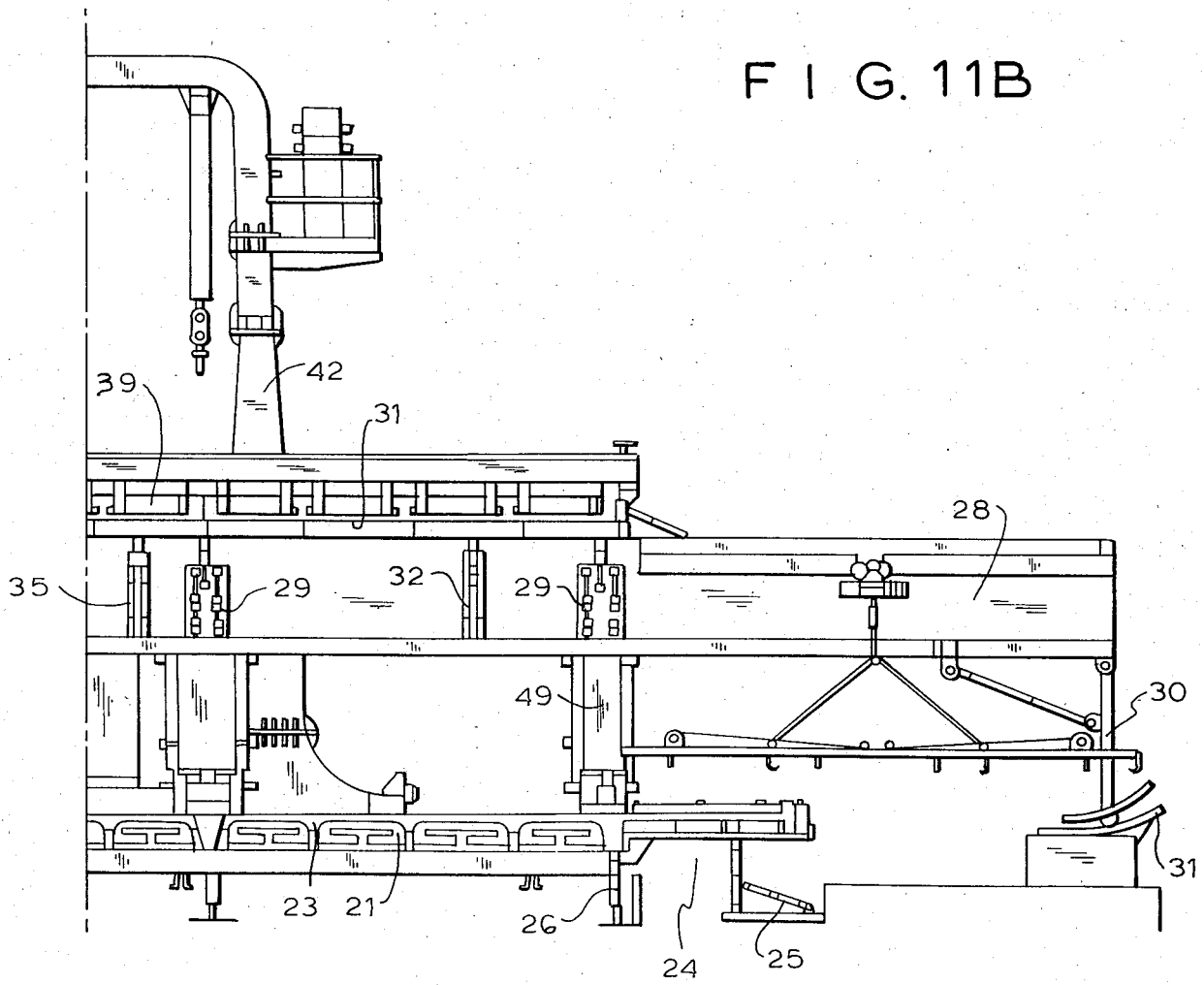
Figure 12:
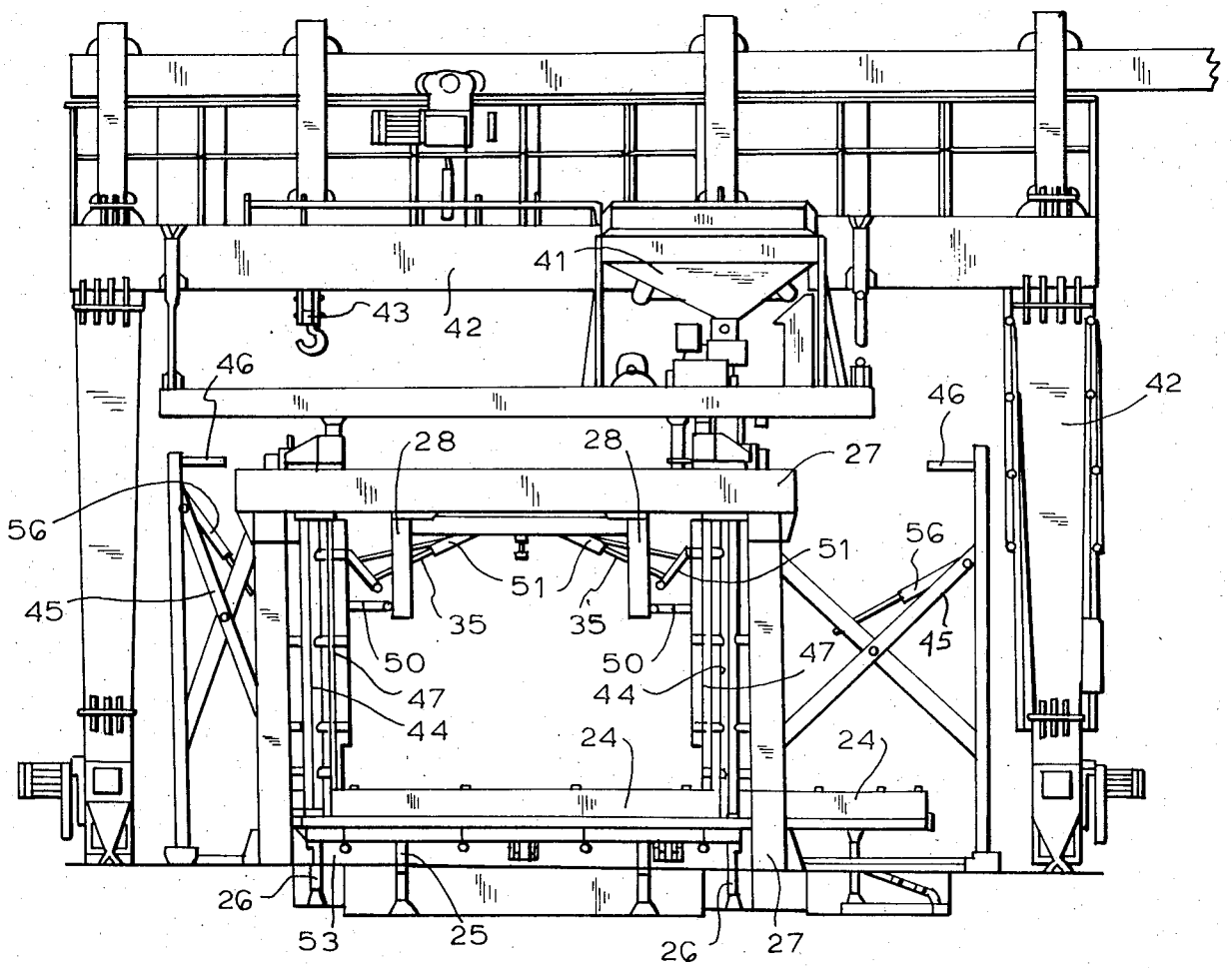
Figure 13:
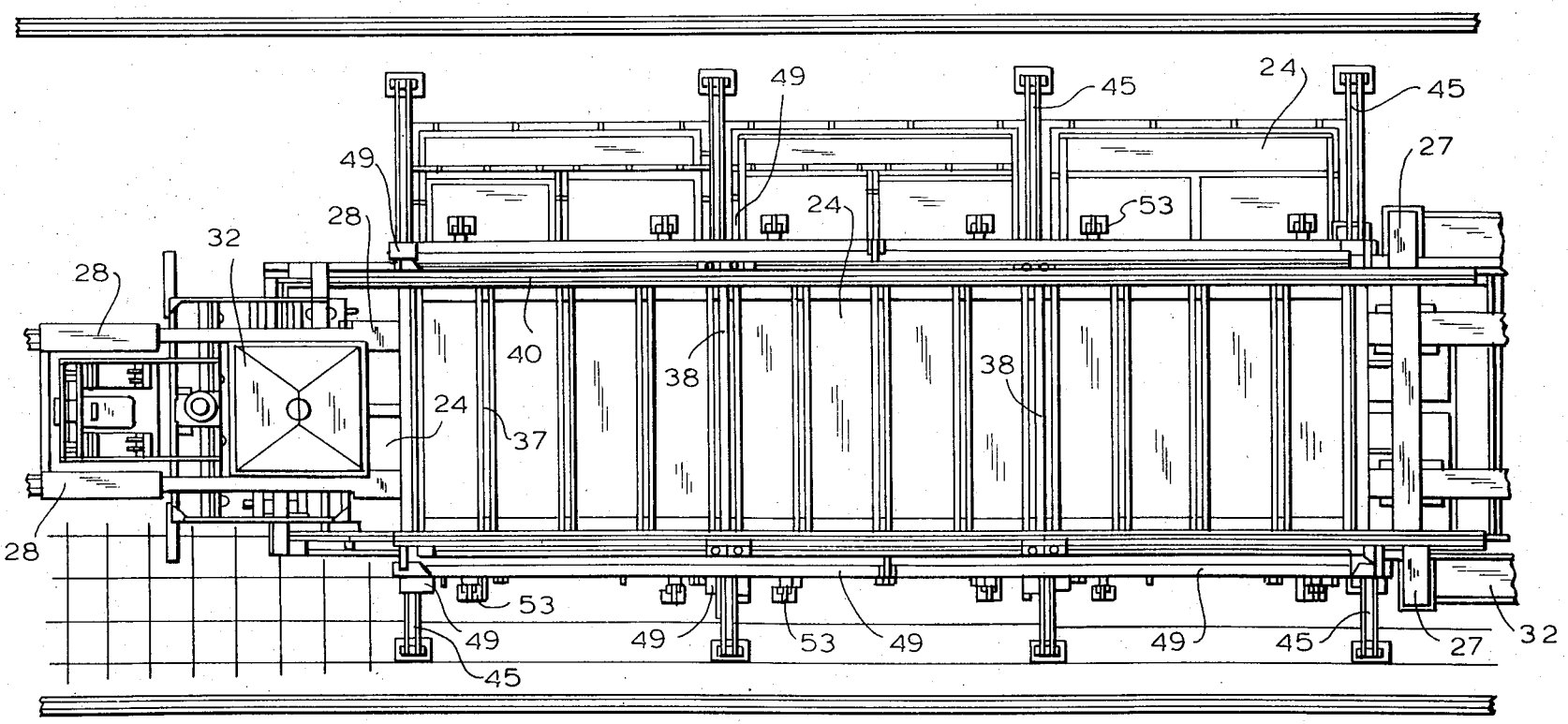
Figure 14:
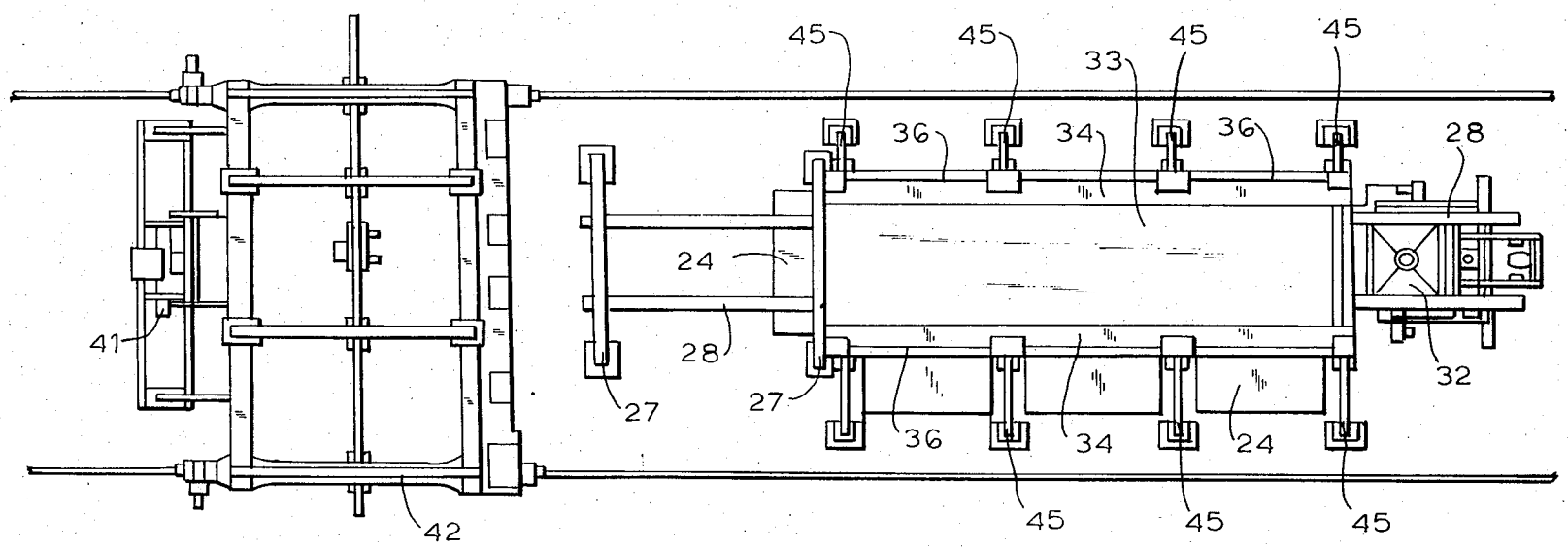
Figure 15:
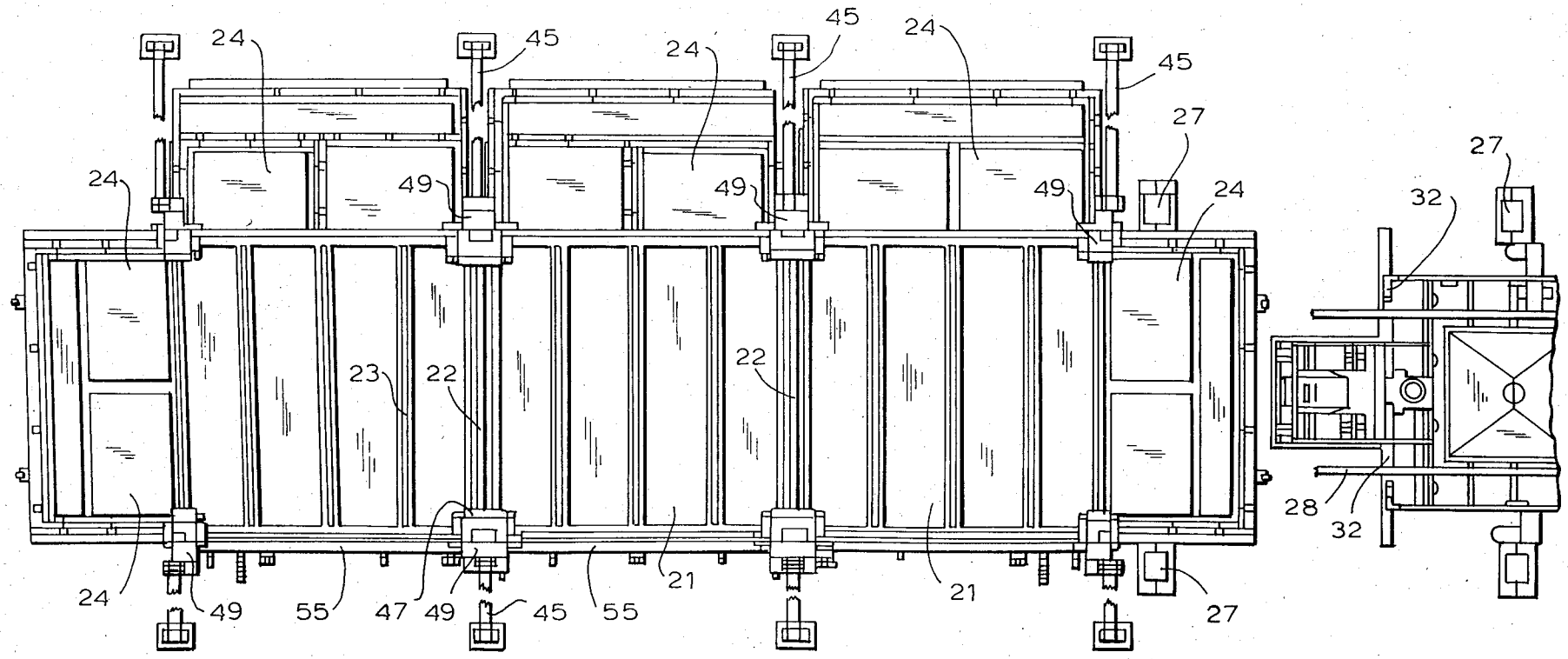

FIG. 11A and FIG. 11B constitutes a view partially in side elevation and partially in vertical longitudinal section of the molding apparatus in accordance with the invention;

FIG. 12 is a view in end elevation of the molding apparatus shown in FIG. 11, the view taken in the direction from right to left to FIG. 11;

FIG. 13 is a view in plan of the molding apparatus shown in FIGS. 11 and 12;

FIG. 14 is a fragmentary view of the molding apparatus showing the horizontal forms included therein; and FIG. 15 is a view in horizontal longitudinal section of the molding apparatus showing the floor forms and the balcony forms.

Figure 4:
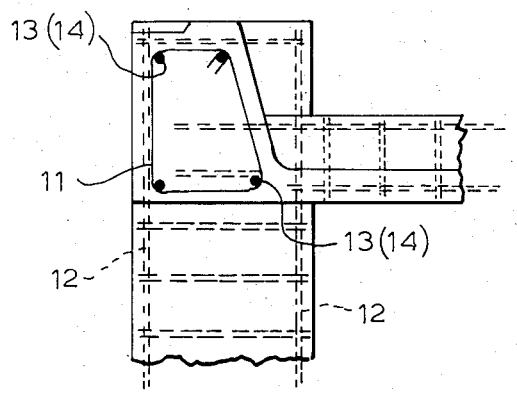
FIG. 4 is a view in vertical cross section taken along the line A—A in FIG. 3
Figure 5:
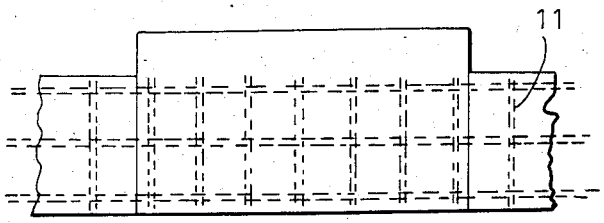
FIG. 5 is a schematic view of a critical zone in the longitudinal cross bar without the middle transverse frame.

Turning first to FIGS. 1 and 2, the box-unit comprises a floor slab 1 and a ceiling slab 2 supported by a spatially reinforced concrete framework composed of longitudinal frames 3 and transverse frames 4 and 5 molded in the longitudinal cross bars 6 and transverse cross bars 7, 8 and columns 9, 10, in which case the transverse frames 4, 5 are located as follows. As shown in FIG. 2 there are two end transverse frames 4 and at least one transverse frame 5 in the middle. According to the invention the cross bars 6 on the longitudinal frames 3 have a reinforced cross section 11 (FIGS. 4, 5, and 9) asymmetrical with regard to the cross section 12 of the columns 9, 10 and an uninterrupted and equivalent reinforcement 13, 14 of the upper and lower cross bars 6 which has a closed shape including the cross bars 6 of the longitudinal frames 3 and the columns 9 of the end transverse frames 4.

Figure 6:
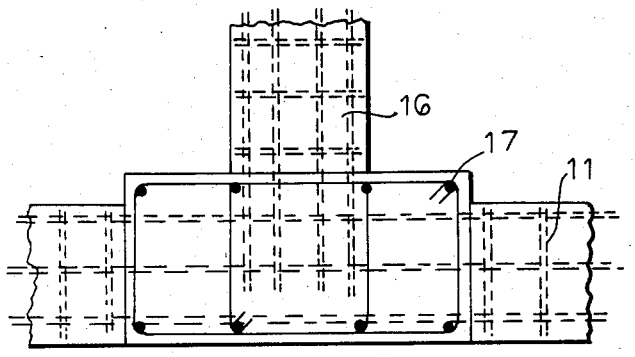
FIG. 6 is a schematic view of a critical zone in the longitudinal cross bar of the middle transverse frame with a double column.
Figure 7:
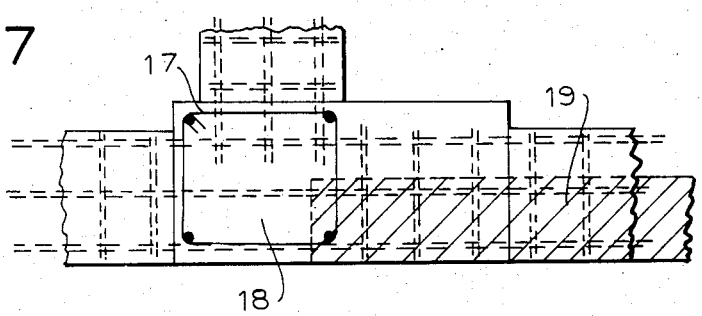
FIGS. 7 and 8 are schematic views of vertical zones with different column locations.
Figure 8:
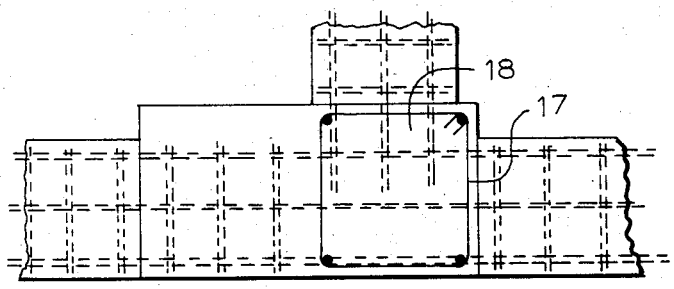
Figure 9:
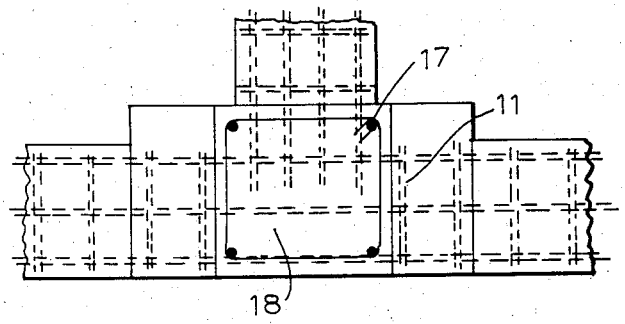
FIG. 9 is a schematic view of a critical zone with a column in the middle transverse frame situated in the center with a single cross section.
Figure 10:
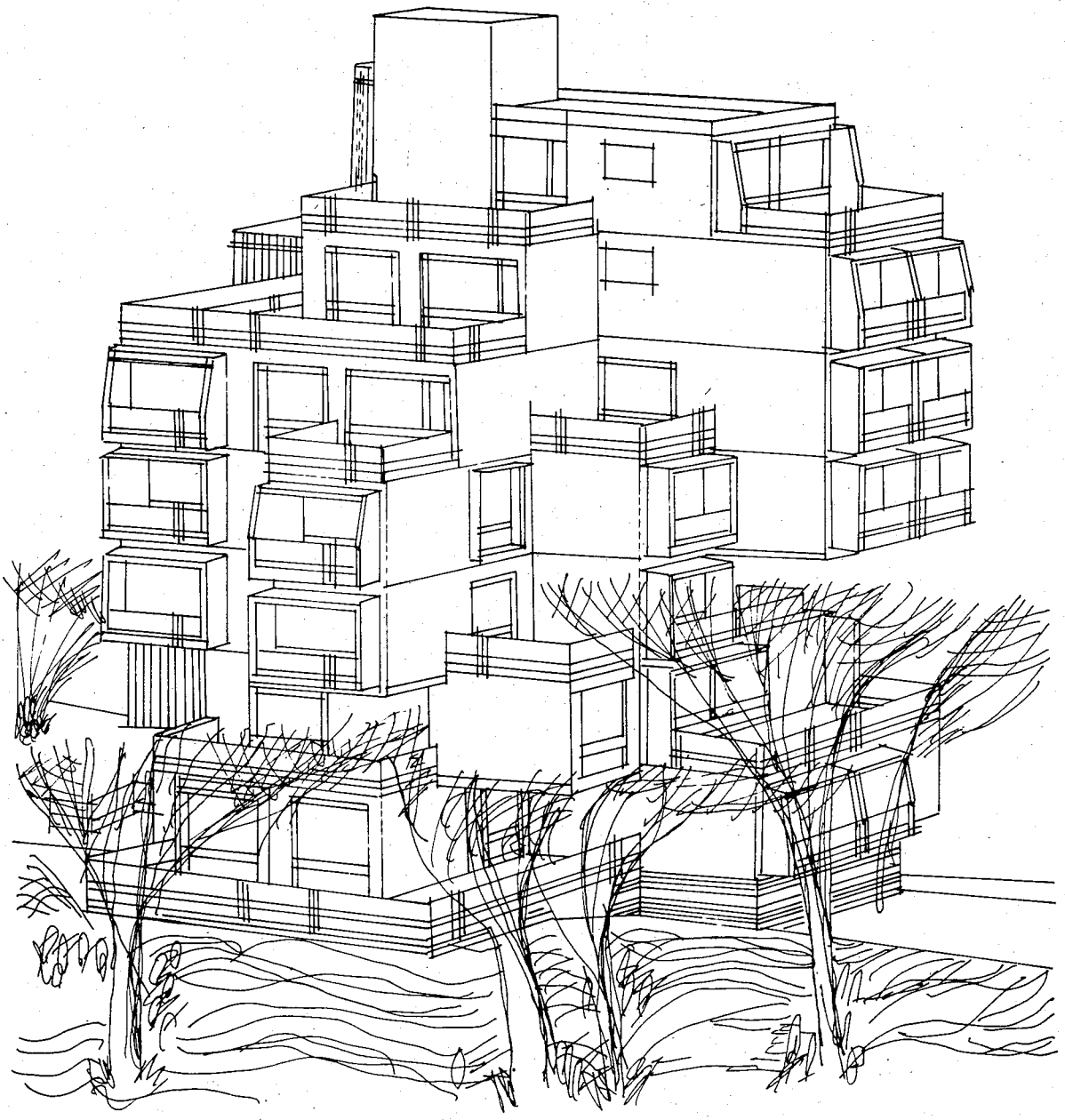
FIG. 10 is an axonometric projection of an exemplary building constructed of box-units in accordance with the invention.

At a modular distance from each other in the cross bars 6 on the longitudinal frames 3 there are critical zones 15 with double cross sections with regard to the cross bars 7 and the columns 9 of the end transverse frame 4 to connect therein the reinforcement 16, 17 (FIG. 6) respectively of the cross bars 8 of the middle transverse frames 5. Each of the cross bars 8 and each of the columns 10 of the middle transverse frames 5 has a varying cross section within the range of from a single cross section to a double cross section. Such a varying cross section of the cross bars 8 and the columns 10 of at least one of the middle transverse frames 5 is made of one single half 18 located to the left, to the right or central as shown in FIG. 7, 8, and 9 or be doubled. The critical zones 15 at the cross bars 6 of the longitudinal frames 3 can be two for each longitudinal cross bar 6 forming three modular lengths. As a variant, there could be only one critical zone 15 at the cross bars 6 thus forming two modular lengths. At least two opposite critical zones 15 at the cross bars 6 of the longitudinal frames 6 are interconnected respectively only by means of the cross bars 8 of the middle transverse frames 5.

Figure 3:
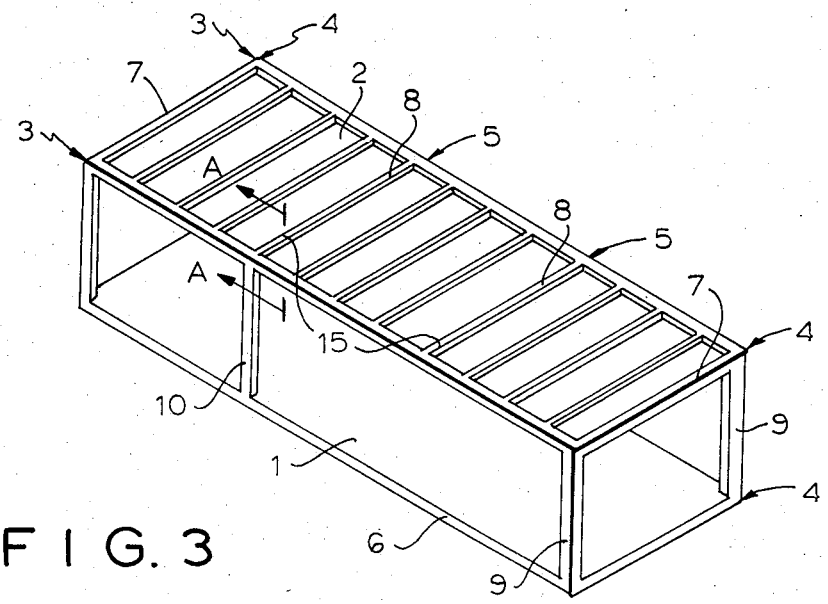
FIG. 3 is a view in a similar projection of a 3-module boxunit with one middle transverse frame.

Turning now to FIG. 3, such a design of the box-unit makes possible the production of the latter with a reduced cross section of the columns 10 of the middle transverse frames or eliminate the columns if required from architectural considerations and allows for the manufacture in the same forms of box-units having, for instance, two middle frames 5 or only one frame situated asymmetrically as shown in FIG. 3, i.e., missing one structural axis at a time. The asymmetrical reinforced cross section of the cross bars 6 of the longitudinal frame 3 provides for the incorporation of webs of beams 19 (FIG. 7) within the box-unit structure thus rendering possible the construction of protruding balconies 20 in the center distance chosen at random as shown in dotted lines in FIG. 1, and the assembly of the box-units in a position turned at 90° towards the underlying and overlying box-units. It is also possible to have the box-unit shorter with the first center distance protruding.

Turning now to FIG. 11–15, inclusive, the molding apparatus according to the exemplary embodiment of the invention consists of lower forms 21 to mold the floor slab divisible in parts at the points of the floor cross bars 22 and/or in the spaces between the ribs 23 of one of their end sectors. Form members 24 with hydraulic mechanisms 25 for the preset rotation of these members around their hinges are hinged to the longitudinal and transverse axes of the lower forms with the purpose of building balconies capable of being split both by the longitudinal and the transverse axes of the box-unit by means of placing typical inserts to perform such splitting of the box-unit and the balconies. When using webs of beams or by leaving holes in the box-unit floor, the inserts are placed at the external shape of the box-unit to serve as fixing members for the webs of beams and to determine the elevation of the floor slab during grouting.

In the sectors of the lower forms forming the longitudinal side beams of the box-unit in the places of the columns there is provided a system of hydraulic units 26 connected to plates forming the bottom of the columns. These hydraulic units 26 are used for the programed removal of the box-unit floor slab from the lower forms 21 and in a transverse direction towards their transverse axis two separate "⊓"-shaped static frames 27 are mounted to hold in a fixed position the one end of the "⊓"-shaped plain girder 28 with holes on the props 29 at the splitting lines of the box-unit. The other end of the "⊓"-shaped plain girder passing along the axis of the molding apparatus is hinged outside the forms on a driven support 30, the loose end of the latter lying in a shaped chute 31 to be used for the forced pulling of the loose end of the plain girder 28 downwards.

A lower grouting machine 32 is moving on the lower part of the "⊓"-shaped girder 28. Horizontal forms 33 which are sectional in a transverse direction are mounted on the plain girder 28. Parallel to the longitudinal axis of the horizontal forms 33 there are rotating form strips 34 connected by means of a programable hydraulic system 35 with the props 29 of the "⊓"-shaped girder 28. These forms strips have in their external part changeable "⌈ "-shaped sections 36 intended for webs of beams. The upper forms 37 located at a distance above the horizontal forms are sectional in the places of the ceiling cross bars 38 and/or in the spaces between ribs 39 of one of their end sectors whose cross sections can be changed with typical inserts to form the main cross sections of the box-unit. On the external horizontal side of the upper forms 37 there are fixed undeformable parallel box-like beams 30 on which the upper grouting machine 41 is mounted, and hinged to the hoist 42 serving the molding facility. The lifting bars to attach the forms to the hooks 43 of the hoist 42 are fitted to the undeformable box-like beams.

To form the external walls of the columns between the lower forms 21 and the horizontal forms 33 on both sides and longitudinally of the molding apparatus there are "⊔"-shaped vertical forms 44 hanging on a system of Nurnberg shears stabilized by upper operator's platforms 46, the shears 45 having a programable horizontal movement. There are 3-wall forms 47, the end walls 48 of which are hinged to the longitudinal edges of the middle wall 48, wall 48, on its part, connected by a cantilever 50 having a horizontal advance; a hydraulic cylinder 51 with a two-directional movement is located around each column of the box-unit as to form the external walls of the columns. To the free longitudinal edges of the end walls 48 of the 3-wall forms 47 "⌈"-shaped vertical sections for the webs of beams are fitted. If necessary to change the cross section of a column or its place in the system of the box-unit, a set of typical inserts of different cross sections are provided in the space formed by the 3-wall forms 43 and the "⊔"-shaped vertical forms 44. As designed, the molding facility is complete with a programmable vibrating system 53 and a heating unit 54 for heating the box-unit.

The production of the box-unit by means of the molding facility according to the invention is performed in the following technological sequence:

After the cleaning and lubrication of the form members, the reinforcement required for the box-unit is supplied within the area of the molding facility and during the reinforcement operation the lower grouting machine 32 is drawn forward in proximity to the driven support 30, while the upper grouting machine 41 is lifted by the hoist 42 into an idle position. The horizontal forms are aligned by means of stabilizing the loose end of the plain girder 28 and transferring the driven support 30 into the shaped chute 31 until it reaches a zero position. The balcony forms 24 are aligned by means of the hydraulic mechanisms 25 and the longitudinal side wall 55 of the lower forms 21 are both retracted by means of hydraulic mechanisms. With the hydraulic mechanism 35 the rotating strips 34 of the horizontal forms 33 are straightened and rotating strips 34 of the horizontal forms 33 are straightened and the external "|||"-shaped forms 44 are sequentially closed in an operating position to have the 3-wall internal vertical forms 43 form the cross section of the columns.

The upper forms 37 come last, being transferred by the hoist 42. Depending on the design of the box-unit, the required inserts are placed in the relevant places in the columns, in the floor and ceiling slabs. Then the reinforcement, grouting, vibrating and heat treatment operations are performed in a programable technological sequence. Upon completion of the heat treatment cycle of the molded box-unit, the various forms are removed by first releasing the 3-wall internal forms 47 of the columns. The upper forms 37 are lifted and transferred outside the area of the molding facility. The form strips 34 of the horizontal form 33 are rotated and the "|||"-shaped vertical form 44 are released with the Nurnberg shears 45. The loose end of the "⊓"-shaped plain girder 28 is pulled downwards by displacement of the loose end of the driven support 30 within the shaped chute 31 for the forced release of the horizontal forms 33 from the ceiling slab of the box-unit and the whole box-unit respectively along its longitudinal axis the box-unit respectively along its longitudinal axis the box-unit turns completely free from the molding apparatus and is pulled out by the hoist 42 to be transferred to the in-plant transport means for the further treatment of the reinforced concrete molding in the finishing working places from which this part of a future building comes out as a finished form.

In the construction of buildings using the box-unit according to this invention, it is necessary to provide the appropriate number of box-units for the zero elevation cycle, stairways and terraces and roof structures as per the architectural design and the number of box-units for the zero elevation cycle, stairways and terraces and roof structures as per the architectural design and the number of stories in the building. The prefabricated box-units are transported to the construction site where the excavation and foundation works have already been done. Each box-unit is mounted at the place shown in the design and its connected to the other box-units is carried out by a known method, for instance, by welding between binding elements provided for this purpose and grouted in the proper place during the molding of each box-unit or by grouting after prestressing the reinforcement.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. In a box-unit including a floor and ceiling slab and a spatially reinforced concrete framework made of two longitudinal frames and a number of transverse frames composed of the relevant cross bars and columns; the said transverse frames being two at the ends and at least one in the middle, the improvement wherein the cross bars of the longitudinal frames have a reinforced cross section asymmetrical as regards the cross section of the columns and an uninterrupted and equal reinforcement of upper and lower cross bars which has a closed shape incorporating the cross bars of the longitudinal frames and the columns of the end transverse frames, and at a modular distance from each other in the cross bars of the longitudinal frames there are provided critical zones with double cross sections with regard to the cross bars and the columns of the end transverse frames to connect in them the reinforcement of the cross bars and the columns respectively of the middle transverse frames and each of the columns, and each of the cross bars of the middle transverse frames has a variable cross section ranging from a single to double cross section.

2. A box-unit according to claim 1, wherein there are two critical zones for each longitudinal cross bar, thus forming three modular distances.

3. A box-unit according to claim 1, wherein there is one critical zone for each longitudinal cross bar, thus forming two modular distances.

4. A box-unit according to claim 1, wherein at least two of the critical zones on the longitudinal cross bars of the longitudinal frames are connected with each other only by means of the cross bars of the middle transverse frames.

* * * * *